United States Patent [19]

Tyler

[11] 3,954,384

[45] May 4, 1976

[54] BURNER SYSTEM

[75] Inventor: Hugh J. Tyler, Santa Ana, Calif.

[73] Assignee: Robertshaw Controls Company, Richmond, Va.

[22] Filed: Feb. 20, 1974

[21] Appl. No.: 444,198

[52] U.S. Cl. ..... 431/47; 73/368.2; 236/99 R; 431/58

[51] Int. Cl.[2] ..... F23Q 9/08

[58] Field of Search ..... 431/43, 47, 58; 236/15 A, 99 R; 73/368.2

[56] References Cited

UNITED STATES PATENTS

| | | | |
|---|---|---|---|
| 2,426,663 | 9/1947 | Bevins | 73/368.2 |
| 2,426,663 | 9/1947 | Bevins | 73/368.2 |
| 3,258,363 | 6/1966 | Lieb | 136/121 |
| 3,312,397 | 4/1967 | Willson | 236/15 A |
| 3,516,791 | 6/1970 | Evans et al. | 252/421 |
| 3,575,542 | 4/1971 | Branson | 236/15 |
| 3,692,239 | 9/1972 | Genbauffe | 236/15 A |
| 3,766,783 | 10/1973 | Tortoso | 73/368.2 |
| 3,823,345 | 7/1974 | Mitts | 317/98 |
| 3,843,308 | 10/1974 | Graham et al. | 431/78 |

FOREIGN PATENTS OR APPLICATIONS

| | | | |
|---|---|---|---|
| 741,981 | 12/1955 | United Kingdom | 431/45 |

OTHER PUBLICATIONS

Adsorption on Saran Charcoal by Jr. Dacy et al., in Trans Faraday Soc., Vol. 50, pp. 740–748 (1954).

Adsorption of Organic Vapours by Saran–Carbon Fibres and Powders – in Carbon (1970), Vol. 8, pp. 761–772.

*Primary Examiner*—Carroll B. Dority, Jr.
*Attorney, Agent, or Firm*—Anthony A. O'Brien

[57] ABSTRACT

A burner system employs a fuel control which supplies fuel flow to a pilot burner and a main burner and which energizes an electric igniter adjacent the pilot burner for igniting the pilot burner. A valve between the control and the main burner is opened when the pilot burner flame is sensed to allow passage of fuel to the main burner which is ignited by the pilot burner. The pilot burner flame is sensed by a bulb adjacent the pilot burner containing a charge of gas and an adsorbent carbonaceous material which is a decomposed compound of carbon and a non-carbon component wherein the non-carbon component has been removed leaving a porous structure with cavities of sufficient size to receive and adsorb the gas.

8 Claims, 6 Drawing Figures

BURNER SYSTEM

BACKGROUND OF THE INVENTION

1. Field of the Invention

The invention relates to burner systems and, in particular, to burner systems employing electrically ignited pilot burners for controlling the operation of main burners.

2. Description of the Prior Art

The prior art, as exemplified in U.S. Pat. Nos. 1,844,959, 2,630,860, 2,705,531, 3,236,448, 3,312,396 and 3,692,239, contains many burner systems including burner systems employing igniter operated pilot burners which control flame valves between a fuel control and a main burner. Generally, the prior art systems utilize flame valves operated by mercury containing sensing bulbs which are limited to a maximum operating temperature in a range of about 398° to 427°C. Also, many prior art burner systems are unduly complex in that they employ many relatively expensive components to produce the safety and desired operating characteristics of the burner system.

Also, the prior art, as exemplified by U.S. Pat. Nos. 2,627,911, 2,787,130, and 3,405,999, contains many thermally operated valves including flame sensing valves for burner systems utilizing gas charged bulbs with adsorbent, activated carbon materials, such as activated charcoal, for operating the valve. Attempts to employ such activated adsorbent material containing flame valves on a large scale in burner systems have generally met with failure; activated carbon materials do not generally produce sufficient increase in volume or pressure change per degree temperature change necessary to operate the burner systems at temperatures associated with flame sensing to warrant the added cost of the carbon materials; and different batches of activated materials exhibit widely varying adsorbent properties at flame sensing temperatures which make reliable operation of burner systems at a predetermined temperature difficult to attain. Gas-fired ovens have generally required liquid-vapor actuated valves, such as mercury actuated valves, to produce the degree of movement of a valve closing member at the particular range of temperatures involved with the flame; however, such liquid-vapor valves are limited to operation at temperatures near the boiling point of the liquid.

Many adsorbent carbon materials are described in the pior art, including polyvinylidene chloride and polyvinylidene fluoride, as exemplified by U.S. Pat. Nos. 1,744,735, 3,258,363, 3,442,819, 3,516,791, and a publication (USSR Academy of Sciences, M. M. Dubinin, "Thermal Treatment and Microporous Structure of Carbonaceous Adsorbents", *Proceedings of the Fifth Conference on Carbon*, Vol. 1, 1962, pp. 81–87). Polyvinylidene chloride and polyvinylidene fluoride, in particular, have been recognized for their "molecular sieve" property, that is, their ability to adsorb certain gaseous materials, which have small molecular sizes and being incapable of adsorbing other gaseous materials which have larger molecular sizes.

SUMMARY OF THE INVENTION

The invention is summarized in that a burner system includes a main burner; a pilot burner disposed in igniting proximity to the main burner; first and second conduits to the respective main and pilot burners; an electric igniter disposed in igniting proximity to the pilot burner; means for controlling fuel flow to both the first and second conduits; said controlling means including switch means for energizing the electric igniter when fuel is supplied to the first and second conduits; valve means interposed in the first conduit between the controlling means and the main burner; flame sensing means for opening the valve means in the presence of a flame from the pilot burner and for closing the valve means in the absence of a flame from the pilot burner; said flame sensing means including a bulb adjacent the pilot burner, an adsorbent carbonaceous material disposed in the bulb, and a charge of gas in the bulb; and said adsorbent carbonaceous material being a decomposed compound of carbon and a non-carbon component wherein the non-carbon component has been removed leaving a porous structure with cavities of sufficient size to receive and absorb the gas.

An object of the invention is to construct a gas burner system which employs an electrically ignited pilot burner for turning on and igniting a main burner at temperatures which are substantially above those in present burner systems.

Another object of the invention is to construct a double burner system for an oven wherein a thermostat control modulates gas supply to a pilot burner which controls and ignites a bake burner, and wherein a flame sensing valve for a broiler burner operates at a temperature above 427°C (800°F) to prevent turn on of the broiler burner in the event the thermostat control becomes defective.

Another feature of the invention is the employment of molybdenum disilicide igniting elements in a burner system offering substantially improved operating characteristics and less cost.

Other objects, advantages and features of the invention will be apparent from the following description taken in conjunction with the accompanying drawings.

DESCRIPTION OF THE PREFERRED EMBODIMENTS

Figure 1:
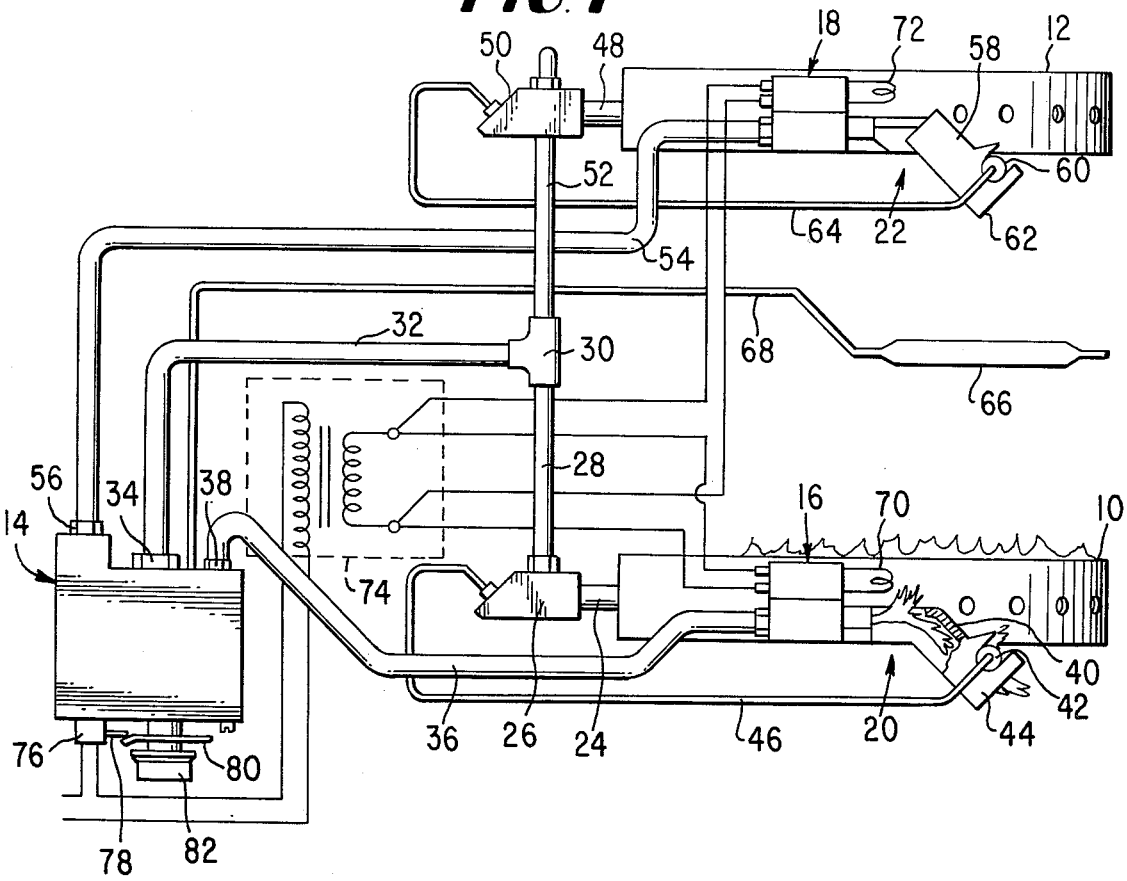
FIG. 1 is a diagram of a burner system in accordance with the invention.

As illustrated in FIG. 1, the invention is embodied in a double burner system for an oven including main burners, such as a bake burner 10 and a broil burner 12 controlled by a control device indicated generally at 14. Electric igniters indicated generally at 16 and 18 are disposed in igniting proximity to the respective bake burner 10 and broil burner 12 and to respective pilot burners indicated generally at 20 and 22 which are in igniting proximity to the respective bake burner 10 and broil burner 12.

The bake burner 10 has its inlet connected to a conduit 24 from a valve 26 communicating with a conduit 28, a T-coupling 30 and a conduit 32 from a main outlet 34 of the control device 14. The pilot burner 20 is connected by a conduit 36 to a bake pilot outlet 38 of the control device 14, and has a deflector 40 positioned to deflect only a portion of the pilot flame from the pilot burner 20 downward into impingement upon a flame sensing bulb 42 mounted on a lower portion 44 of the pilot burner 20 spaced from the flame pattern of the bake burner 10. The flame sensing bulb 42 is connected by a capillary or tube 46 to the valve 26 for controlling the valve 26.

Similarly, the broil burner 12 has its inlet connected to a conduit 48 from a valve 50 which is connected by a conduit 52 to the T-coupling 30 and the main outlet 34 of the control device 14. The pilot burner 22 is connected by a conduit 54 to a broil pilot outlet 56 of the control device 14, and has a deflector 58 for deflecting only a portion of the pilot flame downward against a flame sensing bulb 60 mounted on a portion 62 of the pilot burner 22 spaced from the flame pattern of the boil burner 12. The flame sensing bulb 60 is connected by a capillary or tube 64 to the valve 50.

A temperature sensing bulb 66 mounted in the oven is connected by a capillar or tube 68 to the control device 14. The igniters 16 and 18 include respective resistance heating elements 70 and 72 connected in parallel across the secondary of a transformer 74 which has its primary connected in series with a switch 76 across a suitable alternating current power source. The switch 76 is normally open and has an operator element 78 which is engaged by a cam 80 mounted on a selector 82 of the control device 14. The selector 82 has an off position, a broil position, and a bake range for selecting a baking oven temperature. The cam 80 is such that the switch operator 78 is operated to close the switch 76 when the selector 82 is in the boil position or any position in the bake range. The electrical resistance igniting elements 70 and 72 are made from a refractory resistance material containing a principal portion of molybdenum disilicide and minor portions of ceramics and/or other materials; such molybdenum disilicide elements being commercially available.

Figure 5:
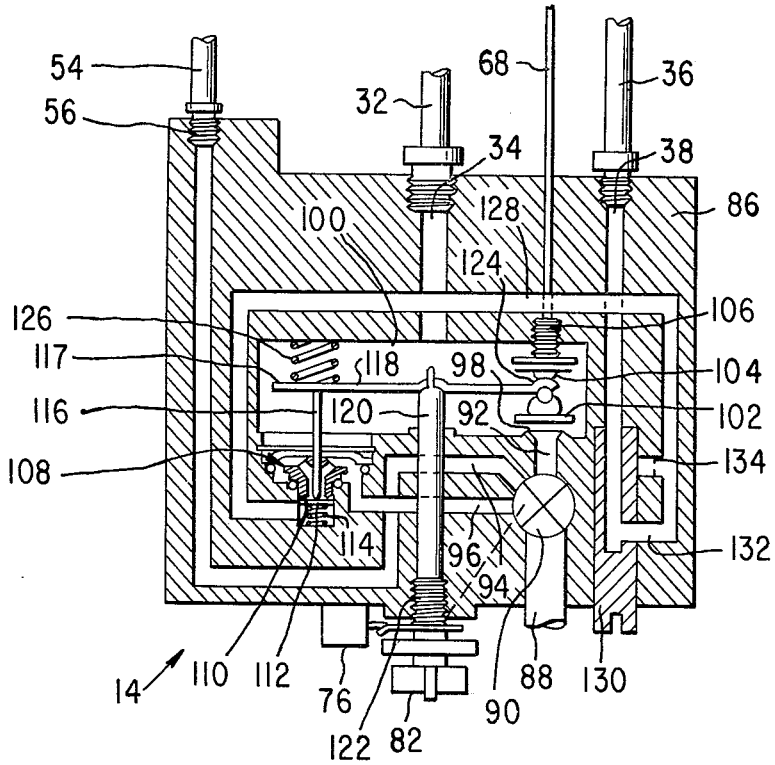
FIG. 5 is a cross sectional view of a fluid flow control device of the burner system of FIG. 1.

The control device 14, as shown in FIG. 5, has a housing 86 with an inlet 88 capable of being connected to a suitable fuel supply, such as a gaseous fuel supply. Valve means 90, such as a cock valve or disc valve, has facilities (not shown) connected to the selector 82 for operating the valve means 90. The valve means 90 is such that when the selector 82 is in the off position, the valve means is closed; when the selector 82 is in a broil position, conduits 92 and 94 are connected to the inlet 88; and when the selector 82 is in any position in the bake range, conduits 92 and 96 communicate with the inlet 88. One suitable construction for such a valve means is disclosed in U.S. Pat. No. 3,692,239.

The conduit 92 communicates through a valve seat 98 into a chamber 100 formed in the housing 86 and which communicates with the main outlet 34. A valve member 102 is mounted on a movable portion 104 of an expandable and contractible member 106 communicating with the tube 68 such that the valve member 102 closes the valve seat 98 in the event the oven temperature sensing bulb 66 senses a high temperature indicating a dangerously hot condition within the oven. The conduit 94 communicates with the outlet 56 to the conduit 54 and the boil pilot burner 22.

The conduit 96 communicates to one side of a valve, indicated generally at 108, which has a valve seat 110 against which a valve member 112 is urged by a spring 114. A valve operator 116 extends between the valve member 112 and one end of a lever 118 which is pivotally engaged at an intermediate point by support 120 extending from a thread adjustment 122 of the selector 82. The other end 124 of the lever 118 engages the movable portion 104 of the expandable and contractible member 106. A spring 126 normally urges the end 117 of the lever 118 pushing the operator 116 toward the valve member 112 to open the valve member 112 and to pivot the lever 118 about the support 120 to normally engage the end 124 against the movable portion 104 of the expandable and contractible member 106. A conduit 128 from the other side of the valve 108 communicates through a gas selecting member 130 to the bake pilot outlet 38. The gas selecting member 130 is such that it can be rotated to connect the conduit 128 through a passageway 132 designed for operation by a relatively low BTU per cubic foot fuel, such an natural gas, or to connect the conduit 128 to a restricted passageway 134 designed for operation by a relatively high BTU per cubic foot content fuel, such as propane.

Figure 2:
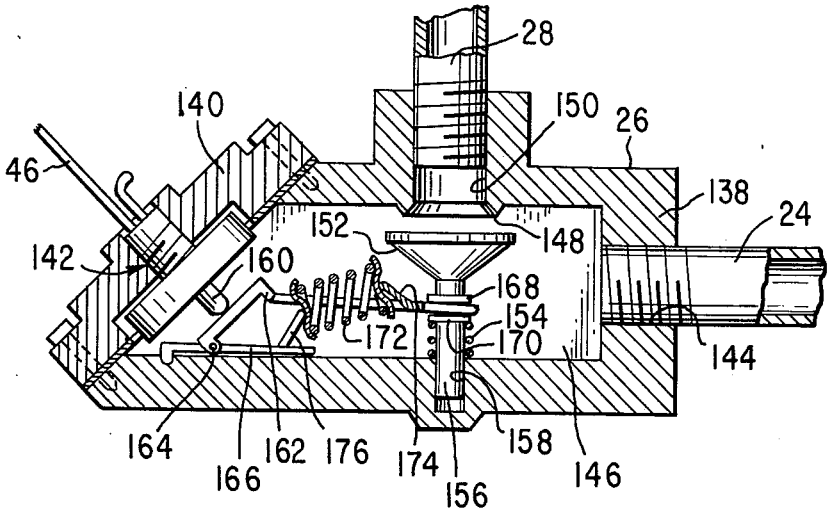
FIG. 2 is a cross sectional view of a flame valve of the burner system shown in FIG. 1.
Figure 3:
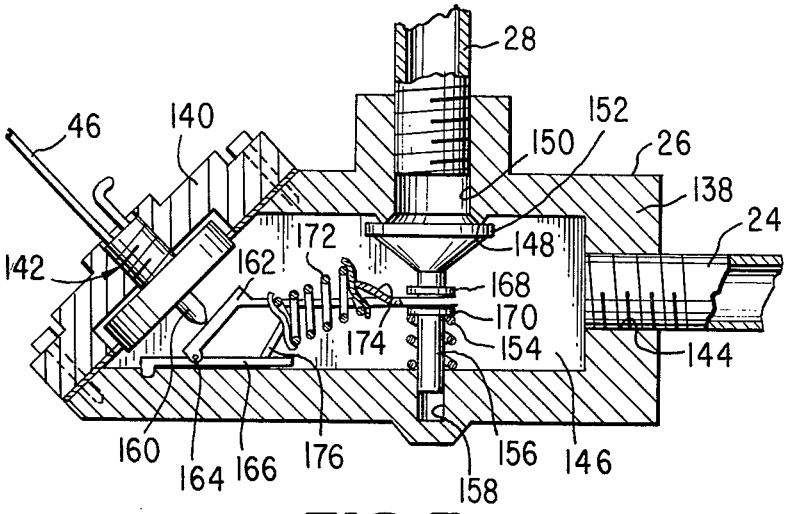
FIG. 3 is a view similar to FIG. 2 but illustrating the valve in a closed position.

As shown in FIGS. 2 and 3, the valve 26 has a housing 138 with a plate portion 140 supporting a valve acutator member indicated generally at 142. The valve 26 has an inlet 144 into which the conduit 24 is secured opening into a chamber 146 from which a valve seat 148 communicates to an outlet 150 in which the conduit 28 terminates. A valve member 152 is biased upward by a compression spring 154 surrounding a valve stem 156 which is slidably mounted within a recess 158 in the housing 138. A plunger 160 extending from the actuator 142 engages a lever 162 pivotally mounted at one end 164 on a support member 166 in the housing 138. The other end of the lever 162 is bifurcated and extends between flanges 168 and 170 mounted on the valve stem 156 of the valve member 152. A compression spring 172 extends between an extending tab 174 on the lever 162 and a tab 176 on the support member 166 such that the spring 172 applies less upward force on the lever 162 when in the lower position, FIG. 2, than in the up position, FIG. 3.

Figure 4:
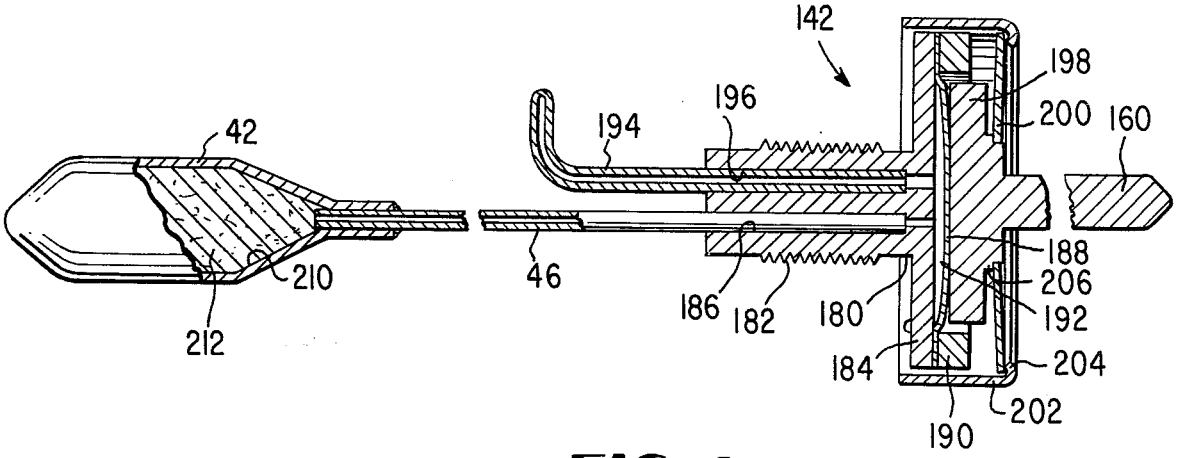
FIG. 4 is a cross sectional view of a valve actuator and flame sensing bulb for the valve of FIGS. 2 and 3.

The actuator 142, as illustrated in FIG. 4, has a support member 180 with a threaded portion 182 and a flange portion 184 through which a bore 186 extends. A flexible metal diaphragm 188, such as a 0.127 millimeter (0.005 inch) thick sheet of 301 stainless steel, is secured by suitable means, such as a spacer 190 and a seam weld to the periphery of a flat face of the flange portion 184 of the support 180 to form a chamber 192 which communicates with the tube 46 suitable secured in the bore 186. A charging tube 194 is secured in a bore 196 of the support member 180 communicating into the chamber 192. The plunger 160 has a head portion 198 which is biased by nonlinear spring means, such as a washerlike or nearly-flat frusto-conical spring 200, known as a Belleville spring. The outer periphery of the spring 200 is held by an annular retainer 202 suitably secured to the flange portion 184 such as by welding. The right side, as viewed in FIG. 4, of the outer periphery of the spring 200 is engaged by a lip 204 of the retainer 202. The left side of the inner periphery surrounding an opening through which the plunger 160 extends engages a shoulder 206 of the plunger 160. The spring 200 is formed from a suitable metal having elastic or spring properties within the range of operation and has an apex which extends to the left, as viewed in FIG. 4.

As used herein, the term "spring rate" or "force differential coefficient" refers to the incremental amount of additional force required to produce an additional incremental deflection for such incremental deflection of a spring. For a linear spring where the deflection is equal to the applied force times a constant, the force differential coefficient is equal to the constant throughout the range of operation of the spring.

The spring 200 has a force per deflection which is nonlinear, wherein a portion of its range of deflection has a low spring rate or force differential coefficient which is substantially less than that of a linear spring. The retainer 202 is positioned on the support member 180 such as to set the operational range of the spring 200 into the portion of its range of deflection where the spring 200 has a low spring rate or force differential coefficient which is substantially less than that of the linear spring throughout the range of movement of the plunger 160.

The bulb 42 and the tube 46 are made from a suitable high temperature flame resistant metal, such as stainless steel 304, INCOLOY 800 and the like, to withstand a flame without building up deposits of unburned fuel. The bulb 42 forms a chamber 210 containing a porous carbonaceous material 212 which has gas adsorbent properties. The chambers 192 and 210, and the tubes 46 and 194 contain a charge of quantity of gas, such as noble gas selected from helium, neon, argon, krypton or xenon. Other gases which are nonreactive at the temperature of use can be employed so long as the gases have a molecular size which is readily absorbed by the carbonaceous material 212. The particular gas used is selected by considering the cost and the desired pressure or volume change which pressure or volume change increases directly with the molecular weight of the gas; for example, xenon produces a greater pressure or volume change per degree temperature change than krypton.

The adsorbent carbon material 212 is made from granules of a compound containing carbon and a non-carbon component by removing the non-carbon component to leave a carbonaceous skeletal structure having cavities of sufficient size to receive and absorb substantial quantities of the gas. Preferably, the compound is a synthetic polymer having volatile components, such as a hydrogen and a halogen, which can be driven off by heat leaving a carbonaceous skeletal structure which is porous. Suitable synthetic polymers are polyvinylidene chloride or polyvinylidene fluoride. Polyvinylidene chloride or polyvinylidene fluoride are formed into adsorbent carbons by carbonizing or pyrolytic decomposition in a purifying atmosphere, such as a vacuum or a purging flow of inert gas. Carbonizing is performed by heating to a temperature less than the melting point but greater than the temperature at which decomposition can be initially observed. For SARAN 113, a copolymer containing about 90% polyvinylidene chloride purchased from Dow Chemical Company, Midland, Michigan, carbonizing is performed at a temperature in the range from 138°C (280°F) to 177°C (350°F). The duration of heating required for complete carbonization of the synthetic polymer is dependent upon the size of the granules of the synthetic polymer and the temperature employed. Along with utilizing a predetermined temperature and duration for a certain size of granular synthetic polymer, observation of a reduction in gas being removed by a vacuum system or the gas being evolved from the granular material can be used to determine when the polymer is completely carbonized. During carbonization, the non-carbon components, that is hydrogen and the halogen, are volatilized and removed from the synthetic polymer structure leaving a carbon skeletal structure which is highly porous. After the synthetic polymer is carbonized, the carbonized polymer can be subjected to a higher temperature up to about 1,510°C (2,750°F) to outgas hydrogen and halogen gases which have been absorbed. Outgasing can be completed in a short duration, for example, 15 minutes.

In manufacture of the valve 26, the granular adsorbent carbon material 212 is placed within the bulb 42. The bulb 42 and tube 46 together with the actuator 142 and valve 26 are assembled with the unsecured end of the charging tube 194 open. An evacuating and gas charging apparatus is connected to the open end of the tube 194 and the bulb 42 is heated and evacuated to outgas air absorbed by the carbon material 212. The temperature of the bulb 42 is then adjusted to a temperature of at least 427°C, and preferably, at least 538°C (1000°F). Then a charge of gas is supplied into the charging tube until the valve is opened by movement of the actuator thereof and the open end of the charging tube is sealed completing the manufacture of the valve 26.

The valve 50, the bulb 60 and the tube 64 are substantially similar to the valve 26, the bulb 42 and the tube 46.

In operation of the oven burner system for an oven shown in FIG. 1, selection of a broil mode of operation is made by turning the selector 82 to the broil position, and selection of a bake mode of operation is made by turning the selector 82 to a desired temperature in the bake range of positions. In both the bake and the broil modes, the cam 80 operates the switch 76 by engaging the switch operator 78 to close the switch 76 energizing the igniters 16 and 18 to heat the refractory resistance heating elements 70 and 72 to igniting temperature. Also, in any bake position and broil position, fuel is supplied to conduit 32 and conduits 28 and 52 to the inlet sides of the valves 26 and 50. In the bake mode, fuel is supplied through conduit 36 and to the bake pilot burner 20 where it is ignited by the igniter element 70. A portion of the pilot flame from the pilot burner 20 is deflected by the deflector 40 against the flame sensing bulb 42 which opens the valve 26 allowing fuel to pass from conduit 28 through conduit 24 to the main burner 10 where it is ignited by either the igniter element 70 or the flame from the pilot burner 20. When the temperature sensed by the oven temperature sensing bulb 66 rises to the temperature selected by the selector 82, the control device 14 terminates the flow of fuel to the conduit 36 thus extinguishing the pilot burner 20 which subsequently allows the bulb 42 to cool closing the valve 26 and terminating the flow of fuel to the bake burner 10. When the temperature sensed by the oven sensing bulb 66 again lowers sufficiently below the temperature selected by the selector 82, the control device 14 again applies fuel to conduit 36 and pilot burner 20; thus, the operation of the bake burner 10 is modulated in accordance with the temperature sensed by the temperature sensing bulb 66 to produce a temperature in the oven which corresponds to the temperature selected by the selector 82.

When the broil position is selected by the selector 82, fuel is supplied to conduit 54 and to the pilot burner 20 where it is ignited by the igniter element 72. A portion of the pilot flame of the pilot burner 22 is deflected by the deflector 58 to impinge upon the flame sensing bulb 60 which opens the valve 50 causing fuel to flow from conduit 52 through conduit 48 to the boil burner 12 where it is ignited by the igniter element 72 and the flame from the pilot burner 22.

Referring to FIG. 5, the rotation of the selector 82 to a position in the bake range of temperatures operates the valve means 90 to connect the inlet 88 to the conduit 92 and the conduit 96. Also, the selector 82 through the screw facilities 122 retracts the support 120 causing the end 117 of the lever 118 to engage the valve operator 116 and move the valve member 112 away from the valve seat 110 completing a passageway from conduit 96 through the valve 108, the conduit 128, gas selector member 130 to the outlet 38. The contractible and retractible member 106 expands with increasing temperatures in the oven to advance the movable member 104 pivoting the lever 118 about the end of the support 120 to move the valve operator 116 to close the valve member 112 with the valve seat 110 when the temperature in the oven reaches the temperature selected by the selector 82, and to open the valve member 112 from the valve seat 110 when the temperature in the oven falls below the temperature selected by the selector 82.

When the selector 82 is in the broil position, the valve means 90 is operated to connect the inlet 88 with the conduit 92 and the conduit 94 to the outlet 56 and to the conduit 54.

In either the bake mode or broil mode, if the temperature in the oven rises above the predetermined selected safe limit temperature, the expandable element 106 advances sufficiently to move the portion 104 to engage the valve member 102 with the valve seat 98 thus closing off communication between the conduit 92 and the outlet 34 to the conduit 32 to shut off fuel flow to the bake burner 10 or the broil burner 12.

Referring to FIGS. 2 and 3, the valve 26 is operated when the actuator 142 advances the plunger 160 to pivot the lever 162 about the pivot point 164 to disengage the valve member 152 from the valve seat 148 to complete a passageway between the inlet 144 and the outlet 150. The valve 26 is closed when the plunger 160 is retracted allowing the force of the springs 154 and 172 to return the valve member 152 upward into engagement against the valve seat 148.

In the frame sensing bulb 42, shown in FIG. 4, the pressure within the chamber 210 is increased when flame impinges upon the bulb 42 due to the desorption of gas from the carbon material 212 and to the increase in kinetic energy of non-adsorbed gas in the chamber 210. Conversely, the pressure within the chamber 212 decreases with the termination of the impingement of flame on the bulb 42 due to the adsorption of gas in the carbon material 212 and to the decrease in kinetic energy of non-adsorbed gas within the chamber 210. The adsorbent carbonaceous material 212 formed from a compound containing both carbon and a non-carbon component by removing the non-carbon component leaving a carbonaceous skelatal structure having cavities of sufficient size to receive and adsorb the gas in the chamber 210 results in a particularly advantageous burner system in that there is made possible new and improved safety features. The volume or pressure change per degree of temperature change of the gas in the chamber 210 due to the adsorption or desorption of gas from the carbon material 212 is substantially greater at flame sensing temperatures than is possible for flame sensing bulbs containing activated charcoal. Previously, in burner systems, fluid containing flame actuated bulbs for valves had to employ liquids, such as mercury, to change from a liquid state to a vapor state to operate the valves. Such liquid vapor systems were generally limited to temperature operation well below 427°C. and, in particular, mercury temperature sensing bulbs were limited to operation in a temperature range from 399°C (750°F) to 427°C. Utilizing the adsorbent carbonaceous material formed from a compound containing both carbon and a non-carbon component by removing the non-carbon component to form a carbonaceous skeletal structure having cavities of sufficient size to receive and adsorb the gas, and in particular, a carbonized synthetic polymer such as carbonized polyvinylidene chloride and polyvinylidene fluoride makes possible the employment of a flame sensing bulb in the burner system which is calibrated well above the 399°C to 427°C maximum range in prior art systems. In particular, the calibration of the flame sensing bulbs 60 and 42 to a temperature of about 538°C offers improved safety features in a burner system in that should the temperature sensing bulb 66 fail resulting in continued operation of the bake burner 10 or the broil burner 12, the resultant increase in heat within the oven would be insufficient to operate the flame sensing bulbs 22 and 46 ensuring that both the bake burner and broil burner would not be operated simultaneously where the oven system is incapable of being heated above 427°C by a single burner. In prior art burner systems, such a failure of the temperature sensing bulb 66 could result in an increase in oven temperature sufficient to operate the flame sensing bulbs resulting in both bake burner and broil burner operation and an increase in temperature within the oven to a degree which is extremely hazardous.

While the structural distinctions or properties of the carbonized synthetic polymer that cause its improved pressure volume change per degree temperature change at temperatures above 427°C and, hence, the improved burner system cannot be visually observed, various theories of the structural properties have been formulated by observation of other properties of the carbonized polymer. Activated carbons, such as activated charcoal, have pores or cavities which are funnel-shaped or cone-shaped; whereas, the carbonized synthetic polymer has cavities which are slit-like or have substantial portions with relatively uniform width throughout the depth of such portions. In making activated carbons, the eroding or activation process produces the funnel-shaped cavities; activating or eroding carbonized synthetic polymer with steam or the like will substantially deteriorate and eventually destory the improved volume or pressure change per degree temperature change of adsorbed gas in the carbonized synthetic polymer. The slit-like cavities of the carbonized synthetic polymer are believed to result from the production of the cavities by removing or volatilizing the non-carbon components of the polymer while in a solid state.

It is also theorized that the width or diameter of the cavities or pores or their inlets, substantially effects the adsorbent properties of the carbon material. Using a Kelvin method of measuring pore size, it has been determined that the pore size of carbonized polyvinylidene chloride ranges from 10 to 15 angstroms in width or diameter, while the diameter of pores in activated charcoal ranges from 15 to 200 angstroms with an average pore size much larger than 17 angstroms. An average cavity or inlet width in the range generally from about 9.2 angstroms to about 17 angstroms and preferably from 12 to 15 angstroms in the carbonized synthetic polymer produces the improved volume or pressure change per degree temperature change. The cavity size of carbonized polymer can be reduced by heating in the range from 1510°C (2750°F) to 2205°C (4000°F). A brief activation with steam, carbon dioxide, or the like can be employed to enlarge the cavities.

Van der Waal's forces are theorized as being the main attractive force resulting in adsorption of gas molecules. The width of the cavities in the carbonized synthetic polymer being slightly larger than two diameters of the monatomic moleculas of noble gas results in increased Van der Waal's forces within the cavities due to the closeness of several crystalline faces, carbon lattice structures, or walls in the cavities. Also, the Van der Waal's forces are generally greater for larger molecules which results in the heavier monatomic gases having a greater volume or pressure change per degree of temperature change than the lighter monatomic gases. Since Van der Waal's forces are attributed to weak dipoles, the carbon lattice arrangement produced by the carbonization of a synthetic polymer may have a stronger dipole than other atomic crystalline structures. The apparent Van der Waal's forces, as judged by internal pressure change per degree of temperature change of the carbonized synthetic polymer are approximately 1.8 times that of activated carbon.

Another structural distinction is found in the number of cavities in a unit weight of the adsorbent carbon material. Carbonized polyvinylidene chloride as measured by a BET method has a surface area of 1200 square meters per gram whereas activated charcoal has a surface area in the range from 500 to 1000 square meters per gram. The surface area is believed to be proportional to the number of pores. The formation of pores or cavities by removing the non-carbon components of a carbonaceous compound leaving a skeletal carbon structure is believed to result in a more porous structure than that formed by eroding or activating cavities in a carbon material.

One advantage of using a noble gas is that the noble gases will maintain their pressure for longer durations of time than more reactive gases, particularly at flame sensing temperatures. It has been observed there is substantially less diffusion of the noble gases into metal than for more reactive gases; thus, the use of a noble gas results in less leakage of gas from the chamber 210 by diffusion through the bulb 42 producing a longer lasting and more reliable flame sensing bulb.

Another advantage of using an adsorbent unactivated carbonized compound as opposed to using an activated carbon is the uniformity that can be achieved in the response of the flame sensing bulbs 42 and 60 of the burner system. Different batches of carbonized polyvinylidene chloride produced in different process runs have substantially identical adsorption properties, whereas different batches of activated charcoal vary widely in adsorption properties; thus, burner systems employing carbonized polyvinylidene chloride in flame sensing bulbs exhibit substantially more uniform and hence more reliable operation.

The employment of the refractory resistance elements 70 and 72 in the igniters together with switch means operated by the selector 82 for energizing the electric igniters in any position of the selector 82, except the off position, results in a particularly low-cost system resulting in a saving of fuel when the burner system is not in operation. The molybdenum disilicide resistance heating elements are particularly advantageous in that they offer substantially improved longevity over other types of resistance heating elements. Further, the resistance heating elements have the advantage that they do not produce radio interference such as is caused by spark igniters and the like. Having the continuously energized igniter elements 70 and 72 in igniting proximity to both the respective pilot burner 20 and 22 and respective bake burner 10 and 12 offers the advantage of igniting the bake or broil burners should the oven temperature increase to a degree where the flame sensing bulbs 42 and 60 are operated.

Figure 6:
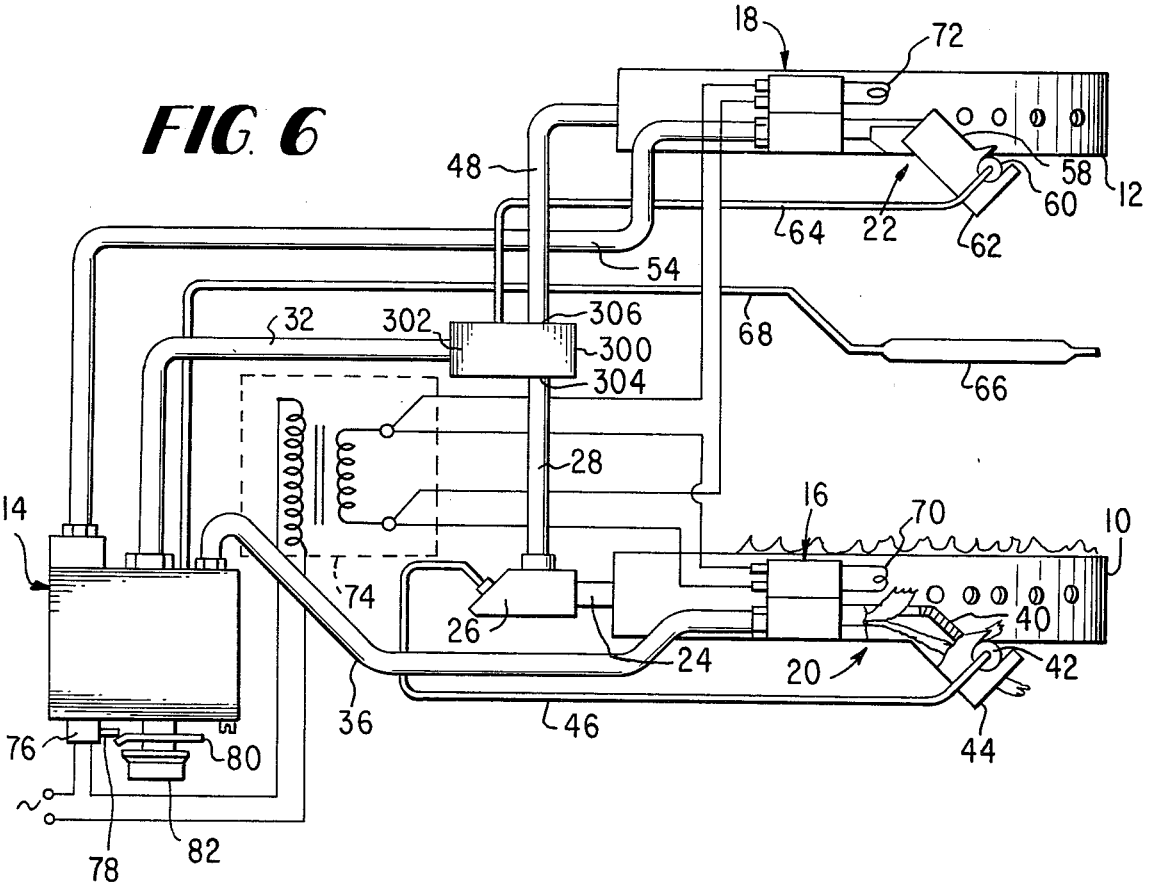
FIG. 6 is a diagram of a modified burner system in accordance with the invention.

A modified burner system is shown in FIG. 6 wherein some of the numerals identifying parts in FIG. 1 are used to identify parts of the modified burner system, illustrating that such similarly identified parts have substantially similar structure and/or function. The modified burner system has a diverter valve 300 with an input 302 connected to the conduit 32 and outputs 304 and 306 connected to the respective conduits 28 and 48. The diverter valve 300 is operated by the flame sensing bulb 60 through the capillary or tube 64, and is of a type which communicates between the inlet 302 and the outlet 304 when the flame sensing bulb 60 is not emersed in a flame, the outlet 306 being closed; and which operates to communicate between the inlet 302 and the outlet 306 closing the outlet 304 when the flame sensing bulb 60 is emersed in a pilot flame. One suitable construction of a diverter valve operated by a flame sensing bulb is shown in U.S. Pat. No. 3,692,239.

In operation of the modified burner system, the diverter valve 300 normally connects the conduit 32 to the conduit 28; thus, when the selector 82 is in a bake position, the pilot 20, the igniter 16, flame sensing bulb 42 and oven temperature sensing bulb 66 control the operation of the burner 10. When the selector 82 is in the broil position, the flame sensing bulb 60 operates the diverter valve 300 disconnecting the outlet 304 from the inlet 302 and connecting the outlet 306 to the inlet 302 to apply the fuel from the conduit 32 to the broil burner 12. The diverter valve 300 prevents the simultaneous supplying of fuel to both the bake burner 10 and the broil burner 12.

Since many modifications, variations and changes in detail may be made to the present embodiments, it is intended that all matter in the foregoing description and in the accompanying drawings be interpreted as illustrative and not in a limiting sense.

What is claimed is:

1. A burner system comprising a main burner;

a pilot burner disposed in igniting proximity to the main burner;

first and second conduits to the respective main and pilot burners;

an electric igniter disposed in igniting proximity to the pilot burner;

means for controlling fuel flow to both the first and second conduits;

said controlling means including switch means for energizing the electric igniter when fuel is supplied to the first and second conduits;

valve means interposed in the first conduit between the controlling means and the main burner;

flame sensing means for opening the valve means in the presence of a flame from the pilot burner and for closing the valve means in the absence of a flame from the pilot burner;

said flame sensing means including a bulb adjacent the pilot burner, an adsorbent carbonaceous material disposed in the bulb and a charge of gas in the bulb; and said adsorbent carbonaceous material being formed from a synthetic polymer selected from the group consisting of polyvinylidene chloride and polyvinylidene fluoride by removing the hydrogen and halogen components leaving a porous structure with cavities of sufficient size to receive and adsorb the gas.

2. A burner system comprising a main burner;

a pilot burner disposed in igniting proximity to the main burner;

first and second conduits to the respective main and pilot burners;

an electric igniter disposed in igniting proximity to the pilot burner;

means for controlling fuel flow to both the first and second conduits;

said controlling means including switch means for energizing the electric igniter when fuel is supplied to the first and second conduits;

valve means interposed in the first conduit between the controlling means and the main burner;

flame sensing means for opening the valve means in the presence of a flame from the pilot burner and for closing the valve means in the absence of a flame from the pilot burner;

said flame sensing means including a bulb adjacent the pilot burner, an adsorbent substantially unactivated carbonaceous material disposed in the bulb and a charge of gas in the bulb;

said adsorbent carbonaceous material having cavities with inlets with an average width in the range from 9.2 to 17 angstroms; and the gas charge consisting essentially of a gas selected from the group consisting of helium, neon, argon, krypton and xenon.

3. A burner system as claimed in claim 2 wherein the gas charge consists essentially of a gas selected from the group consisting of krypton and xenon.

4. A double burner system for an oven comprising a bake burner;

a first pilot burner disposed in igniting proximity to the bake burner;

a first electric igniter having energizable means disposed in igniting proximity to the first pilot burner;

a broil burner;

a second pilot burner disposed in igniting proximity to the broil burner;

a second electric igniter having energizable means disposed in igniting proximity to the second pilot burner;

first, second, third and fourth conduits to the respective bake burner, first pilot burner, broil burner, and second pilot burner;

means for controlling fuel flow to the second and fourth conduits, said controlling means including means for selecting a bake mode to apply fuel to the second conduit, and for selecting a broil mode to apply fuel to the fourth conduit, said controlling means further including main outlet means to which fuel is supplied when either the bake mode or the broil mode is selected and switch means for simultaneously and continuously energizing the first and second electric igniters when either the bake mode or broil mode is selected;

first valve means between the main outlet of the controlling means and the first conduit;

first flame sensing means for opening the first valve means in the presence of a flame from the first pilot burner and for closing the first valve means in the absence of a flame from the first pilot burner;

second valve means between the main outlet of the controlling means and the third conduit, and second flame sensing means for opening the second valve means in the presence of a flame from the second pilot burner and for closing the second valve means in the absence of a flame from the second pilot burner;

said second flame sensing means including a bulb adjacent the second pilot burner, an adsorbent carbonaceous material disposed in the bulb, and a charge of gas in the bulb; and said adsorbent material being formed from a synthetic polymer selected from the group consisting of polyvinylidene chloride and polyvinylidene fluoride by removing the hydrogen and halogen components, leaving a porous structure with cavities of sufficient size to receive and adsorb the gas.

5. A double burner system for an oven as claimed in claim 4 wherein said first flame sensing means includes a bulb adjacent the first pilot burner, an adsorbent carbonaceous material disposed in the bulb, and a charge of gas in the bulb, said adsorbent carbonaceous material of the first flame sensing means being formed from a synthetic polymer selected from the group consisting of polyvinylidene chloride and polyvinylidene fluoride by removing the hydrogen and halogen components leaving a porous structure with cavities of sufficient size to receive and adsorb the gas.

6. A double burner system for an oven as claimed in claim 4 wherein the controlling means includes means for interrupting the fluid flow to the main outlet means when the temperature exceeds a predetermined temperature which is below 427° C, and the first and second flame sensing means open the respective first and second valve means at a temperature above 427° C and close the respective first and second valve means at temperatures below 427° C.

7. A double burner system for an oven as claimed in claim 5 wherein the controlling means includes means to interrupt the fluid flow to the main outlet means when the temperature in the oven exceeds a predetermined temperature which is below 427° C, and the first and second flame sensing means open the respective first and second valve means at temperatures above about 538° C and close the respective first and second valve means at temperatures below about 538° C.

8. A double burner system for an oven as claimed in claim 4 wherein the energizable means of the first and second electric igniters includes a refractory resistance element formed from a refractory material containing a principal portion of molybdenum disilicide.

* * * * *